United States Patent [19]

Pambianchi

[11] Patent Number: 4,991,312

[45] Date of Patent: Feb. 12, 1991

[54] DOOR OPENING SYSTEM FOR WASHING MACHINES

[75] Inventor: Mauro Pambianchi, Bologna, Italy

[73] Assignee: I.L.S.A. Srl., Bologna, Italy

[21] Appl. No.: 499,004

[22] Filed: Mar. 26, 1990

[51] Int. Cl.[5] ..... F26B 13/10

[52] U.S. Cl. ..... 34/45; 34/55; 34/87

[58] Field of Search ..... 34/87, 50, 51, 54, 55, 34/44, 45, 46, 133

[56] References Cited

U.S. PATENT DOCUMENTS 3,273,256 9/1966 Behrens ..... 38/87 X

*Primary Examiner*—Henry A. Bennet

*Attorney, Agent, or Firm*—McAulay Fisher Nissen & Goldberg

[57] ABSTRACT

A control device and system for controlling the opening of a loading and unloading door of a dry washing machine when internal thereof the machine reaches a predetermined maximum gas concentration including a probe having two electrodes spaced from each other for measuring ohmic resistance of air interposed therebetween the ohmic resistance being changeable and responsive to a concentration of the gas contained within the washing machine, the probe measures the solvent concentration degree which is present at the time of measurement in the machine, the probe is coupled with an electronic circuit for controlling the air circulation in the washing machine, and the probe is responsive to a value prefixed and when the value is reached, the probe activates the electronic circuit for breaking the circuit and cuts off air circulation inside the washing machine, and another electronic circuit is coupled with the one electronic circuit for controlling an electrovalve which drives a linear variator with a pneumatic piston to disengage a shackle locking the loading and unloading door.

20 Claims, 1 Drawing Sheet

DOOR OPENING SYSTEM FOR WASHING MACHINES

BACKGROUND OF THE INVENTION

This invention relates to a system for opening a door of a washing machine and a device for controlling a washing machine door and causing the door to open in response to gas concentration in the interior of the washing machine reaching a predetermined level.

FIELD OF THE INVENTION

This invention is concerned with a system for controlling the gas concentration of a solvent present and additives in washing machines which takes place at the end of a drying phase to provide for the automatic opening of a door, hereinafter also referred to as a loading door conventionally used for loading and unloading of the washing machine as soon as a predetermined value of gas concentration fixed in advance has been reached.

DESCRIPTION OF THE PRIOR ART

After washing and treating phases of clothing with the solvent and additives takes place, normally a first drying phase is also carried out by means of heated air which is allowed to pass through the clothing in order to remove any solvent contained therein. Subsequently, cooling of the clothing heated during drying is carried out in an exchanger provided for this purpose in order to recover or to remove the solvent. As soon as this cooling operation is complete, a so-called "reduction or deodorizing phase" is carried out, which consists in a blasting of the solvent with a high gas concentration and, subsequently, a door to the loading opening can be opened and the clothing can be take out and removed from the machine.

At present, there is no satisfactory system for checking of the gas concentration caused by the solvent and there is no system for reducing the gas concentration. An empirical system is now used, i.e., based on tests previously performed in which it was previously established that, in order to obtain the required value, a reduction phase must be carried out during a period of certain time. This checking system, however, does not provide any safety assurance since many factors may affect it in different ways, and the present system may also determine values of gas concentration based on unknown or uncontrollable factors which may differ even substantially from the ones foreseen during the tests. Among these factors are the kind or type of clothing being handled, the condition of use of the washing-drying machines, and last but not least, the condition and the kind of solvent used must be taken into consideration. Consequently, the disadvantages that affect a system like the one now used and based on previous tests are evident. Furthermore, it is important to bear in mind that present sanitary and anti-pollution rules in force in many countries, particularly European countries, require that, at the end of a washing cycle, the solvent concentration inside of the washing machine as well as any solvent remaining in the clothing should not exceed a maximum established value, so that, when the loading door to the washing machine is opened, workers or users are not intoxicated or affected by the pollution and the surrounding area is not polluted.

SUMMARY OF THE INVENTION

The invention provides for an integral solution to the problem by fitting the washing machine with a apparatus and a system for use therewith for checking the degree of gas concentration of the solvent contained in the interior of the washing machine. This system, by adopting either one or more bearing or sensing elements and by means of a control device, which when the requested or maximum value of gas concentration is reached, automatically causes the loading and unloading door to the washing machine to open so that clothing can be removed from the basket in the interior of the washing machine.

To these ends, the invention is concerned with a control device for controlling the opening of a loading and unloading door of a dry washing machine when internal thereof the machine reaches a predetermined maximum gas concentration and includes a probe having two electrodes spaced from each other for measuring ohmic resistance of air interposed between the electrodes either in the washing machine or at an exit portion thereof, the ohmic resistance being changeable and responsive to a concentration of the gas contained within the washing machine such that the probe is adapted to measure the solvent concentration degree which is present at the time of measurement in the machine, a first electronic circuit is coupled with the probe for controlling the air circulation in the washing machine and the probe is responsive to a value prefixed and when the prefixed value is reached the probe activates the first electronic circuit for breaking the circuit and cuts off the air circulation inside the washing machine, and a second electronic circuit is coupled with the first electronic circuit for controlling an electrovalve which drives a linear variator having a pneumatic piston to disengage a shackle locking the loading and unloading door.

The invention is also concerned with a control system for checking the ga concentration in a washing machine and controlling the opening of a loading and unloading door of the washing machine when the gas concentration internally thereof reaches a predetermined value, and the system provides for a sensing probe associated with the machine for measuring the ohmic resistance of air emanating from the washing and drying area of the machine, and to measure the solvent concentration degree which is present at the time of measurement, the first electronic circuit coupled with the probe is responsive to the fixed value which when reached is operative to render the washing machine inoperative and the air circulation inside the washing machine cut off, and the second electronic circuit is coupled with and responsive to the first electronic circuit to disengage the shackle to open the loading door.

DESCRIPTION OF THE PREFERRED EMBODIMENTS

Figure 1:
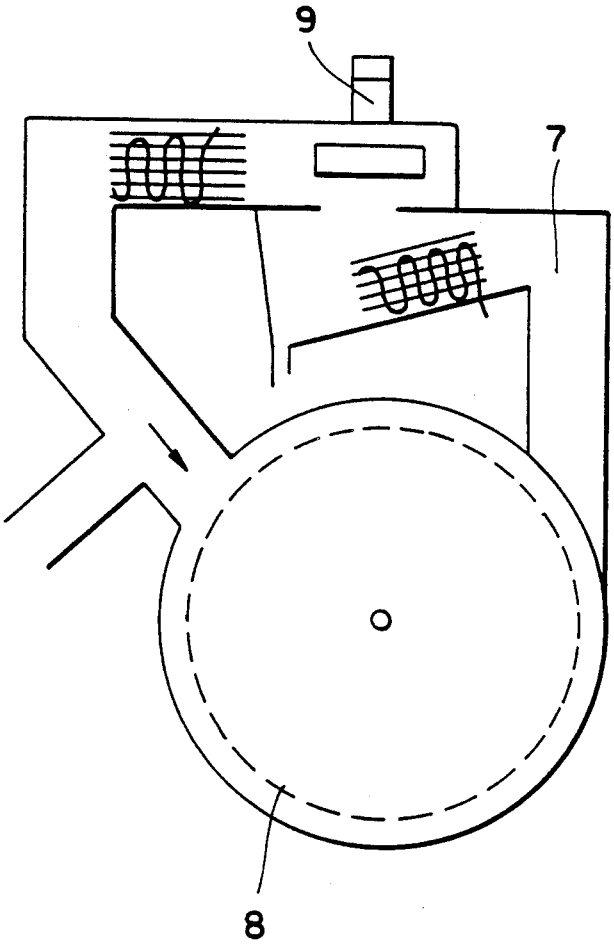
FIG. 1 is a schematic view of a washing machine which includes a washing and a drying phase and showing the position of the sensing probe.

Referring more particularly to FIG. 1 of the drawing which illustrates the best mode for carrying out the invention, there is provided a first sensing probe 1 schematically shown which is in the interior of a washing machine 10 and comprises two electrodes 12, 14 within the air stream within the washing machine for measuring the ohmic resistance of air interspersed between and flowing between the two electrodes in the direction of the arrows A1, A2, A3 and A4. Since this ohmic resistance between the two electrodes 12, 14 coupled with sensing probe 1 changes according to the gas concentration existing in the machine and since the gas concentration also forms part of the air flow as defined by arrows A, this probe has the capability of being responsive to the degree of solvent gas concentration existing at that moment or particular time in the washing machine.

Figure 2:
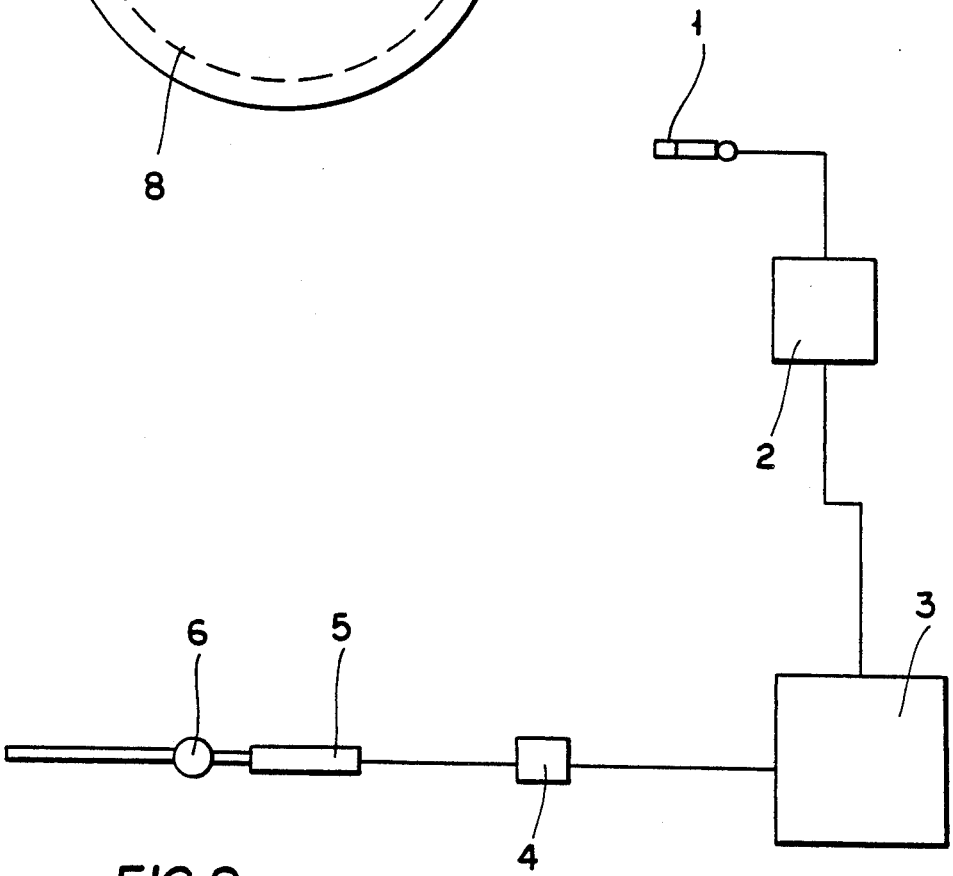
FIG. 2 is a schematic showing of a circuit diagram of a circuit for use with the bearing or sensing system for determining the gas concentration for controlling a pneumatic linear actuator to disengaging a shackle locking the loading-unloading door of the washing machine and causing the door to open.

As best seen in FIG. 2 which illustrates an electronic circuit diagram, there is provided an electronic circuit 2 which includes a potentiometer connected with probe 1, schematically shown. The ohmic resistance output of probe 1 which varies in accordance with the gas concentration is then taken and applied as an input to first electronic circuit 2, and after the ohmic resistance of probe 1 reaches a predetermined value, electronic circuit 2 is responsive to the aforesaid predetermined value to cut off air circulation inside washing machine 10, as soon as the value predetermined or quantity of gas concentration permitted is fixed in advance, and such gas concentration has been reached. A second electronic circuit 3 is coupled with electronic circuit 2 potentiometer output; electronic circuit 3 is coupled with electrovalve 4 for controlling electrovalve 4 to activate a linear variator having a pneumatic piston 5 for unblocking a door shackle 6 to cause an opening of the loading door for loading and unloading the washing machine.

In one preferred embodiment of the washing machine a single probe 1 is positioned in canal 7 of the machine to pick gas solvent concentration existing in the air coming from tumbler 8 and sucked up or exhausted by means of exhaust fan 9. In order to change the gas concentration value at which probe 1 must intervene, the electronic circuit 2 is variably controlled by means of the potentiometer which is adjustable from and controlled from outside of the washing machine.

In a modified version, a second probe similar to probe 1 can be used as an auxiliary detector outside of the washing machine at one air exit of the machine, and included as part of fan chamber 9 which includes an exhaust fan schematically shown as part of exhaust chamber 9 such as at the exhaust of fan chamber 9. At this exit, proximate to fan chamber 9, there is provided a container 16 of activated carbons which can be fitted to the exhaust exit to keep back the gas. The positioning of probe 1 in the fan chamber 9 provides for an alternative checking position and can be used to modify existing washing machines which were built without an internal sensing probe such as probe 1.

Container 16 containing the activated carbons can also be provided with a probe similar to or the same as probe 1 to check the outlet gas concentration. It is possible to have the probes in different areas of the gas flow to determine with a high degree of accuracy the gas concentration. Consequently, when this probe in container 16 shows an outlet gas concentration which is unsatisfactory, it is a signal that it is necessary to intervene to regenerate or change the activated carbons. The use of the probe fitted outside of the washing machine 10 associated with container 16 enables one to observe the solvent gas concentration, thus allowing a stopping of tumbler 8 to stop the washing machine and to observe any anomaly in the unit operation.

Probe 1 when fitted with activating carbon containing container 16 can also be used to modify existing machines.

In carrying out the invention, one or more probes may be used to ascertain the gas concentration of the solvent. The components as well as anything else can be replaced and/or integrated with other technically equivalent ones.

In carrying out the specific operation of the invention, it is within the scope of the invention to modify existing washing machines by using a probe outside of the washing machine and providing an unlocking device to unlock the door or a door shackle.

While it is preferred to have the probe positioned in the air flow canal inside of the machine to determine the concentration of solvent which is present in the air coming from a tumbler in the washing machine and sucked through fan 8 for exhaust to the atmosphere, it is also possible to use a probe outside of the washing machine which is coupled with potentiometer 2 for regulating the concentration value at which the probe outside of the machine intervenes and shuts down operation. For greater safety, it is also possible to use two probes, one probe positioned inside the machine and another outside of the machine.

When the probe is outside of the machine, it can be positioned in an exhaust duct from the machine and can, if desired, be used as an auxiliary detector to detect air exiting at one air exit from the machine, and the container of activated carbons can also be fitted at the air exit for keeping back the gas in addition to the probe, the probe being preset for selecting an outlet of solvent gas concentration from the air exit.

While there has been shown and described what is considered to be the preferred embodiments of the invention, various changes and modifications may be made therein without departing from the scope of the invention.

I claim:

1. A control device for controlling the opening of a loading and unloading door of a dry washing machine when internal thereof the machine reaches a predetermined maximum gas concentration, comprising:

a probe associated with said machine, said probe including two electrodes spaced from each other for measuring ohmic resistance of air interposed between said electrodes, the ohmic resistance being changeable and responsive to a concentration of the gas contained within the washing machine, said probe being adapted to measure the solvent concentration degree which is present at the time of measurement in the machine;

a first electronic circuit coupled with said probe for controlling the air circulation in said washing machine;

said probe being responsive to a value pre-fixed and when said value is reached, said probe activates said first electronic circuit for breaking the circuit and cuts off the air circulation inside the washing machine; and a second electronic circuit coupled with said first electronic circuit for controlling an electrovalve which drives a linear variator with a pneumatic piston to disengage a shackle locking the loading and unloading door.

2. The device of claim 1, wherein said probe is positioned in an air flow canal in said machine to determine the concentration of solvent which is present in the air coming from a tumbler in said washing machine and sucked through a fan for exhaust to the atmosphere.

3. The device of claim 1, including a potentiometer coupled with said probe for regulating the concentration value at which said probe intervenes and shuts down operation.

4. The device of claim 3, wherein said potentiometer forms part of said first electronic circuit.

5. The device of claim 1, wherein said probe is positioned inside said machine.

6. The device of claim i, wherein said probe is positioned outside said machine.

7. The device of claim 1, including:

an air exit;

said probe being positioned in an exhaust duct from said machine and is used as an auxiliary detector to detect air exiting at said air exit from said machine; and a container of activated carbons fitted at said air exit for keeping back the gas;

said probe being pre-set for selecting an outlet of solvent gas concentration from said air exit, an intervention being required to regenerate or replace the activated carbons;

said probe enabling the observation of the solvent gas concentration, thus providing for said intervention to stop said tumbler fan in the machine as well as to detect an anomaly in the machine operation.

8. The device of claim 7, wherein said probe is positioned in said container of activated carbons.

9. The device of claim 7, including an exhaust fan chamber coupled with said duct, and said probe being positioned in said exhaust fan chamber.

10. A control system for checking the gas concentration in a washing machine and controlling the opening of a loading and unloading door of a washing machine when gas concentration internally thereof reaches a predetermined value, comprising:

a probe associated with the machine for measuring the ohmic resistance of air emanating from a washing and drying area of the machine, said probe being responsive to ohmic resistance and the ohmic resistance being changeable and responsive to the concentration of the gas contained in the inside of the washing machine;

said probe being adapted to measure the solvent concentration degree which is present at the time of measurement in the machine;

a first electronic circuit coupled with said probe and responsive thereto and the fixed value to which said probe is responsive and, when said fixed value is reached, said electronic circuit being operative to render the washing machine inoperative and to stop the air circulation inside the washing machine; and a second electronic circuit coupled with and responsive to said first electronic circuit when said fixed value is reached for controlling an electrovalve driving a linear variator coupled with a pneumatic piston to disengage a shackle for locking the loading door and opening the loading door.

11. The system of claim 10, wherein said probe is positioned in an air flow canal in said washing machine for determining the concentration of solvent which is present in the air coming from a tumbler exhausted and by means of an exhaust fan.

12. The system of claim 10, wherein said probe is positioned outside of said washing machine in an air flow exhaust air canal from said washing machine.

13. The system of claim 10, including a potentiometer coupled with said probe for regulating gas concentration value at which said probe is rendered operative to intervene.

14. The system of claim 10, including:

positioning said probe at an air exit from the washing machine;

providing a container of activated carbons fitted at said air exit for keeping back the gas, said container being juxtaposed to said probe;

said probe being programmable for selecting a quantity of solvent gas concentration and causing an intervention to shut down operation of the washing machine to permit regeneration or replacement of the activated carbons; and use of the probe outside of the washing machine enables an observer to observe the solvent gas concentration, thus allowing said intervention in order to stop a fan at the air exit as well as to note any anomaly in the machine operation.

15. The system of claim 14, wherein said probe is positioned in said container of activated carbons.

16. The system of claim 15, including positioning another of said probes inside said machine in the air flow canal.

17. The system of claim 14, wherein said probe includes two electrodes spaced from each other located inside said machine and positioned in the air flow canal to measure the ohmic resistance of the air flow subjected to the gas concentration inside of the machine.

18. The system of claim 10, wherein said probe includes two electrodes spaced from each other located inside said machine and positioned in the air flow canal to measure the ohmic resistance of the air flow subjected to the gas concentration inside of the machine.

19. The system of claim 18, including a potentiometer coupled with said probe for regulating gas concentration value and controlling the value at which said probe intervenes.

20. The system of claim 19, including another of said probe located in an air exhaust canal outside of said washing machine and the said exhaust canal coupled with said air flow canal, and another potentiometer coupled with said other probe for controlling the value at which said other probe intervenes.

* * * * *